United States Patent [19]

Otterbeck

[11] 4,009,746

[45] Mar. 1, 1977

[54] AWNING SYSTEM OR THE LIKE

[76] Inventor: Finn Otterbeck, Gravdalsvejen 12, Oslo 7, Norway

[22] Filed: Nov. 24, 1975

[21] Appl. No.: 634,656

[52] U.S. Cl. ..... 160/323 R
[51] Int. Cl.[2] ..... E06B 9/24
[58] Field of Search ..... 160/323 R, 323 B, 391, 160/392, 395, 396, 400, 23, 387, 19; 211/45, 46; 248/498

[56] References Cited

UNITED STATES PATENTS

| | | | |
|---|---|---|---|
| 330,015 | 11/1885 | Goodin | 160/387 |
| 2,175,761 | 10/1939 | Quinlan | 160/19 |
| 3,854,517 | 12/1974 | Nakamura | 160/323 R |

*Primary Examiner*—Peter M. Caun
*Attorney, Agent, or Firm*—Albert L. Jeffers; Roger M. Rickert

[57] ABSTRACT

An awning system wherein a screening material piece is provided at the edge connected with the winding rod with a thickened portion, the winding rod being provided with a longitudinal extending cavity having a narrow portion at the surface of the rod and a wider portion inside the narrow portion, the screening material having its thickened portion received in the wider portion of the cavity and extending away from the cavity through the narrow portion thereof, the cavity being open at at least one end of the rod, and bearing arrangements rotatably supporting the ends of the rod, at least one of the bearing arrangements being formed with a passage having at least the same sectional size as the thickened edge portion of the screening material and being so related to the open end of the cavity that the rod is rotatable to a position in which the thickened edge portion of the screening material piece is in the longitudinal direction of the rod removable from and introducable into the cavity through said passage in order to disconnect the screening material from and connect the material with the rod.

5 Claims, 6 Drawing Figures

AWNING SYSTEM OR THE LIKE

BACKGROUND OF THE INVENTION

1. Field of the Invention

The present invention relates to an awning system or the like.

An awning system comprises a piece of screening material, a winding rod connected with one edge of the piece of screening material, a bearing arrangement rotatably supporting the ends of the rod and means for rotating the rod in order to wind the screening material piece to the rod or unwind it therefrom.

2. Description of the Prior Art

The awning systems previously known are disadvantageous in the respect that it is complicated to connect the screening material with the winding rod and especially to exchange the screening material of an assembled awning system for a new screening material.

SUMMARY OF THE INVENTION

The object of the invention is to provide an improved awning system in which it is possible to connect the screening material piece with the rod and disconnect the material therefrom without dismounting the winding rod from the bearing arrangements.

The awning system or the like according to the invention comprises a screening material piece which is provided at the edge connected with the winding rod with a thickened portion, a winding rod having a longitudinal extending cavity having a narrow portion at the surface of the rod and a wider portion inside the narrow portion, the screening material having its thickened portion received in the wider portion of the cavity and extending away from the cavity through the narrow portion thereof, the cavity being open at at least one end of the rod, and bearing arrangements rotatably supporting the ends of the rod, at least one of the bearing arrangements being formed with a passage having at least the same sectional size as the thickened edge portion of the screening material and being so related to the open end of the cavity that the rod is rotatable to a position in which the thickened edge portion of the screening material piece is in the longitudinal direction of the rod removable from and introducable into the cavity through said passage in order to disconnect the screening material from and connect the material with the rod, respectively.

In an awning system according to the invention it is easy to connect the screening material with the winding rod and it is also possible to exchange the screening material of an assembled awning system for another screening material without the necessity of dismounting the winding rod from the bearing arrangements.

BRIEF DESCRIPTION OF THE DRAWINGS

The invention is described in the following with reference to the accompanying drawings.

DESCRIPTION OF THE PREFERRED EMBODIMENTS

Figure 1:
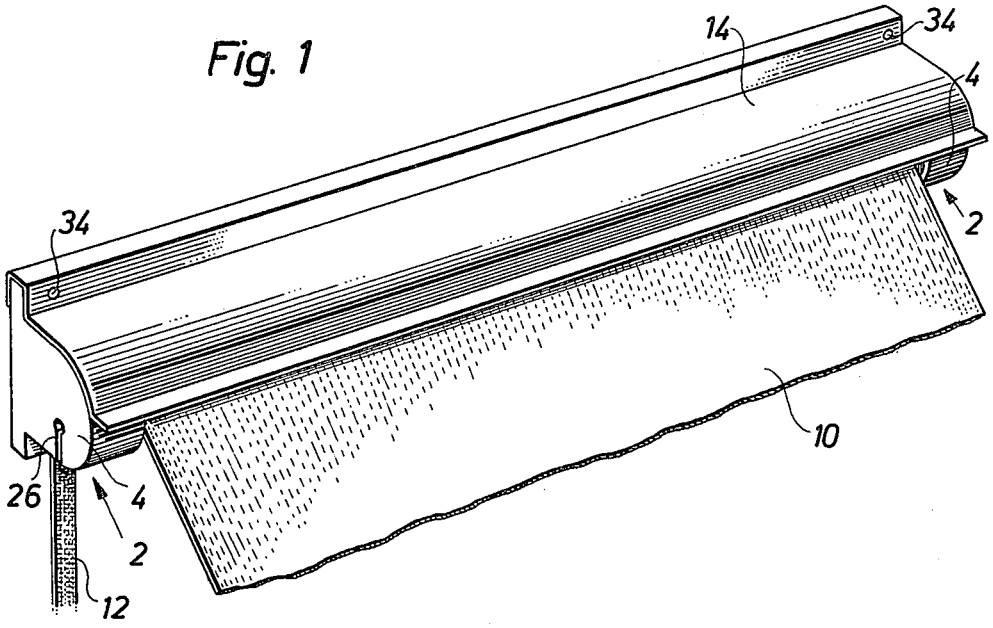
FIG. 1 is a perspective view of an awning system according to the invention.
Figure 2:
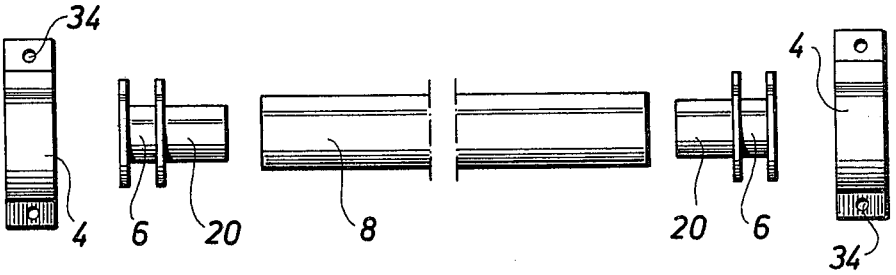
FIG. 2 is an exploded side view of the system of FIG. 1.
Figure 3:
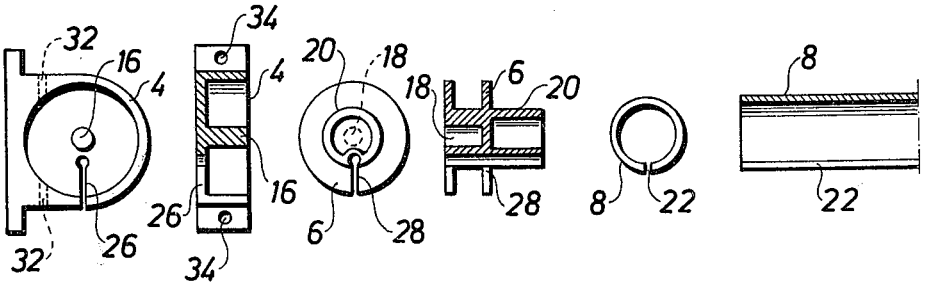
FIG. 3 shows end views of the different parts of the system shown in FIG. 2.

In FIG. 1 there is shown an awning system comprising two spaced bearing arrangements 2 each comprising a bearing housing 4 and a drum 6 (not visible in FIG. 1) rotatably journalled therein, a rod 8 having its ends connected with the drums to be rotatable therewith, a piece of awning cloth 10 having one edge portion connected with the rod, a strap 12 connected with one of the drums 6 for controlling the rotation thereof in order to provide the winding and unwinding of the awning cloth to and from the rod 8, and a covering plate 14.

The housing 4 encloses the drum on all sides except the side facing the rod 8. The housing is provided with a central bearing pin 16 engaging a central opening 18 in the drum for rotatably supporting the drum 6. The drum 6 is provided with a projection 20 projecting into the rod 8 for supporting the rod 8 which is thereby rotatable in relation to the housings 4. The two bearing arrangements at each end of the rod 8 are of the same design, and thereby the manufacturing of the housings and the drums constituting the bearing arrangements is simplified.

The rod has the form of a tube provided with a longitudinal slot 22. The edge portion of the awning cloth 10 connected with the rod is provided with an elongated bar 24 which is thicker than the width of the slot 22. In the assembled condition of the awning system the edge portion of the awning cloth provided with the bar 24 is positioned within the slotted tube 8, the cloth extending to the outside of the tube through the slot 22. Thereby the awning cloth is in an effective way connected with the rod 8. The awning cloth is connected with the tube 8 by inserting the bar 24 and the edge portion of the cloth connected therewith into the tube from one end thereof.

In order to simplify the connection of the cloth with the tube 8 and make it possible to exchange the cloth 10 without disassembling the bearing arrangements 2 and detaching the tube 8 from the system the bearing arrangements are provided with passages 26 in the housings 4 and passages 28 in the drums 6. The passages 26 and 28 have substantially the same shape and size as the bar 24 and the edge portion of the awning cloth connected therewith. The drums 6 are so connected with the tube 8 that the passages 28 are positioned opposite to the slot 22 of the tube 8. When the drums 6 and thereby the tube 8 are rotated to a position in which the passages 28 and the slot 22 are opposite to the passages 26 of one of the housings 4 there is established a continuous passage from outside the side wall of the housing to the slot 22 of the tube 8. It is recognized that in this position it is possible to connect the awning cloth with the tube 8 by introducing the bar 24 and the edge portion of the cloth connected therewith into the tube through said continuous passage, as appears from FIG. 4. Thus, it is possible to connect the cloth with the awning system and of course also exchange the cloth without dismounting the bearing arrangements or disconnecting the tube 8 from the drums 6.

Figure 4:
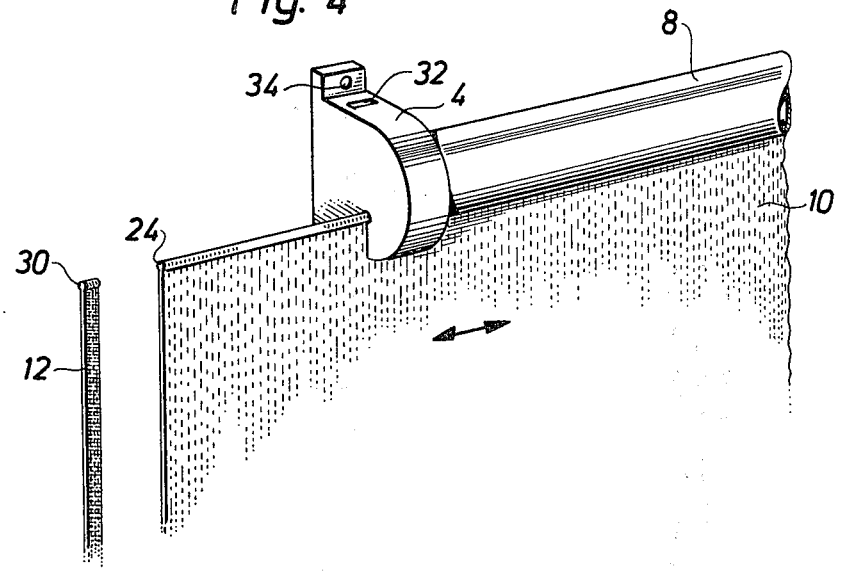
FIG. 4 is a perspective view showing a step of the mounting of the awning system of FIG. 1.

As appears from FIG. 4 it is possible to connect the end portion of the strap 12 with one of the drums 6 according to the same principles as the awning cloth is connected with the tube 8. Thus, the end of the strap 12 is provided with a bar 30 which is introducable in the passage 28 in the drum and is thereby connected with the drum. The strap 12 is wound onto the drum 6 and is thereupon used for controlling the rotation of the drum 6 and the tube 8 in order to wind the awning cloth to the tube or unwind the cloth therefrom. The housings 4 are formed with openings 32 for the passage of the strap 12 and is also provided with holes 34 for making it possible to fasten the housings to for example a wall by means of screws.

Figure 5:
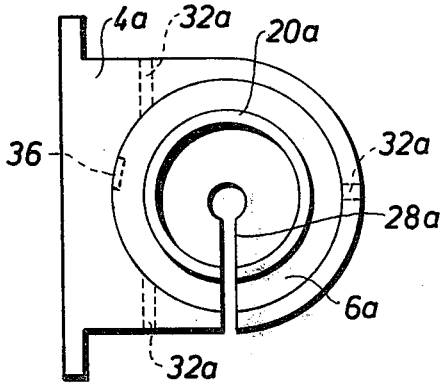
FIG. 5 is an end view of a bearing arrangement of a modified embodiment of an awning system according to the invention; and, FIG. 6 is an axial section of the bearing arrangement of FIG. 5.
Figure 6:
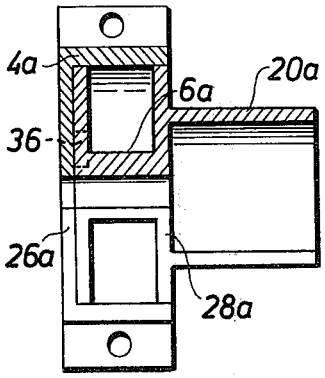

In FIGS. 5 and 6 there is shown a modified embodiment of a bearing arrangement in an awning system according to the invention. In this embodiment the housing 4*a* does not have any bearing pin for the drum 6*a*. The drum is rotatably journalled by having its periphery engaging the inner wall of the housing. Thereby it is possible to let the passages 26*a* and 28*a* extend to about the center of the housing and the drum. The side of the drum 6*a* opposite from the projection for connecting the drum with the winding tube of the awning system is formed with a cavity 36 for making it possible to introduce the strap when positioning the drum in the housing.

The invention can be modified within the scope of the following claims.

I claim:

1. An awning system or the like comprising a screening material piece which is provided at the edge connected with the winding rod with a thickened portion, a winding rod having a longitudinal extending cavity having a narrow portion at the surface of the rod and a wider portion inside the narrow portion, the screening material having its thickened portion received in the wider portion of the cavity and extending away from the cavity through the narrow portion thereof, the cavity being open at at least one end of the rod, and bearing arrangements rotatably supporting the ends of the rod, at least one of the bearing arrangements being formed with a passage having at least the same sectional size as the thickened edge portion of the screening material and being so related to the open end of the cavity that the rod is rotatable to a position in which the thickened edge portion of the screening material piece is in the longitudinal direction of the rod removable from and introducable into the cavity through said passage in order to disconnect the screening material from and connect the material with the rod, respectively.

2. An awning system as claimed in claim 1, in which each bearing arrangement comprises a bearing housing and a drum rotatably journalled in the housing and unrotatably connected with the rod.

3. An awning system as claimed in claim 2, in which the drum of one of the bearing arrangements is provided with a strap for controlling the rotation of the drum and thereby the rotation of the rod.

4. An awning system as claimed in claim 2 wherein the said passage extends through both the bearing housing and the drum of the at least one bearing arrangement.

5. An awning system as claimed in claim 4 in which the drum of the at least one bearing arrangement is provided with a strap for controlling the rotation of the drum and thereby the rotation of the rod, the strap including a thickened edge portion introducible into the drum passage in the longitudinal direction, the drum passage having a narrow portion through which the strap may pass while blocking passage of the thickened edge to thereby hold the strap to the drum.

* * * * *